US009556839B2

(12) United States Patent
Zhang et al.

(10) Patent No.: US 9,556,839 B2
(45) Date of Patent: Jan. 31, 2017

(54) METHOD FOR OPERATING A FUEL INJECTION SYSTEM AND FUEL INJECTION SYSTEM COMPRISING FUEL INJECTION VALVES WITH A PIEZO DIRECT-DRIVE

(71) Applicant: Continental Automotive GmbH, Hannover (DE)

(72) Inventors: Hong Zhang, Tegernheim (DE); Detlev Schoeppe, Wenzenbach (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 238 days.

(21) Appl. No.: 14/381,745

(22) PCT Filed: Mar. 14, 2013

(86) PCT No.: PCT/EP2013/055212
§ 371 (c)(1),
(2) Date: Aug. 28, 2014

(87) PCT Pub. No.: WO2013/139671
PCT Pub. Date: Sep. 26, 2013

(65) Prior Publication Data

US 2015/0128910 A1 May 14, 2015

(30) Foreign Application Priority Data

Mar. 19, 2012 (DE) ..... 10 2012 204 251

(51) Int. Cl.
*F02M 51/06* (2006.01)
*F02M 47/02* (2006.01)
(Continued)

(52) U.S. Cl.
CPC ..... *F02M 51/0603* (2013.01); *F02D 19/027* (2013.01); *F02D 28/00* (2013.01);
(Continued)

(58) Field of Classification Search
CPC ..... F02M 21/0254; F02M 51/0603; F02M 51/061; F02M 47/022; F02M 47/025; F02M 47/027; F02M 57/005; F02M 61/08; F02M 2200/70; F02M 2200/24; F02M 2200/244; F02M 2200/0602; F02D 41/3809; F02D 41/2096; F02D 41/3836; F02D 19/027; F02D 28/00; F02D 2041/2445
(Continued)

(56) References Cited

U.S. PATENT DOCUMENTS 6,318,342 B1 11/2001 Simon et al. ..... 123/494
6,345,606 B1 * 2/2002 Ricci-Ottati ..... F02D 41/3872 123/456
(Continued)

FOREIGN PATENT DOCUMENTS

DE 3103061 A1 8/1982 ..... H01L 41/083
DE 19827287 A1 12/1999 ..... F02M 51/06
(Continued)

OTHER PUBLICATIONS

International Search Report and Written Opinion, Application No. PCT/EP2013/055212, 9 pages, May 31, 2013.

*Primary Examiner* — Lindsay Low
*Assistant Examiner* — George Jin
(74) *Attorney, Agent, or Firm* — Slayden Grubert Beard PLLC

(57) ABSTRACT

A method for operating a fuel injection system includes detecting the pressure prevailing in a pressure accumulator using a fuel injection valve piezo actuator that includes, in addition to the active piezo region used to actuate the closing element, a passive piezo region that acts as a pressure sensor. Using this pressure sensor, the closing element force acting
(Continued)

on the passive piezo region, and therefore the pressure prevailing in the pressure accumulator, can be determined.

17 Claims, 3 Drawing Sheets

(51) Int. Cl.

| | |
|---|---|
| ***F02D 19/02*** | (2006.01) |
| ***F02D 41/20*** | (2006.01) |
| ***F02M 65/00*** | (2006.01) |
| ***F02D 28/00*** | (2006.01) |
| ***F02D 41/38*** | (2006.01) |

(52) U.S. Cl.
CPC ..... *F02D 41/2096* (2013.01); *F02D 41/3809* (2013.01); *F02M 47/027* (2013.01); *F02M 65/00* (2013.01); *F02D 2200/0602* (2013.01); *F02D 2250/31* (2013.01); *F02D 2400/08* (2013.01); *F02M 2200/24* (2013.01); *F02M 2200/247* (2013.01)

(58) Field of Classification Search
USPC ... 123/498, 490, 499, 456; 239/102.1, 102.2
See application file for complete search history.

(56) References Cited

U.S. PATENT DOCUMENTS

| | | | | |
|---|---|---|---|---|
| 6,953,158 | B2 | 10/2005 | Liskow | 239/102.2 |
| 7,372,188 | B2 * | 5/2008 | Thies | F02D 41/2096 310/316.01 |
| 2003/0106533 | A1 * | 6/2003 | Crofts | F02M 47/027 123/446 |
| 2004/0149840 | A1 | 8/2004 | Remmels et al. | 239/584 |
| 2005/0173564 | A1 * | 8/2005 | Cooke | F02M 47/027 239/533.1 |
| 2006/0255695 | A1 | 11/2006 | Endriss | 310/366 |
| 2008/0209990 | A1 * | 9/2008 | Hanari | F02D 41/042 73/114.38 |
| 2009/0118982 | A1 * | 5/2009 | Kondo | F02M 47/027 701/104 |
| 2010/0263633 | A1 * | 10/2010 | Kondo | F02M 47/027 123/478 |
| 2013/0327301 | A1 * | 12/2013 | Brandt | F02D 41/2096 123/478 |

FOREIGN PATENT DOCUMENTS

| | | | | |
|---|---|---|---|---|
| DE | 19960971 | A1 | 3/2001 | F02M 51/06 |
| DE | 10024662 | A1 | 12/2001 | F02D 41/20 |
| DE | 10129375 | A1 | 1/2003 | F02M 47/02 |
| DE | 10162250 | A1 | 7/2003 | F02M 51/00 |
| DE | 19952774 | B4 | 3/2004 | F02M 55/02 |
| DE | 10345730 | A1 | 4/2005 | H01L 41/083 |
| DE | 102006027665 | B3 | 9/2007 | F02D 1/02 |
| WO | 2005/108771 | A1 | 11/2005 | F02D 41/20 |
| WO | 2013/139671 | A1 | 9/2013 | F02D 41/20 |

* cited by examiner

METHOD FOR OPERATING A FUEL INJECTION SYSTEM AND FUEL INJECTION SYSTEM COMPRISING FUEL INJECTION VALVES WITH A PIEZO DIRECT-DRIVE

CROSS-REFERENCE TO RELATED APPLICATIONS

This application is a U.S. National Stage Application of International Application No. PCT/EP2013/055212 filed Mar. 14, 2013, which designates the United States of America, and claims priority to DE Application No. 10 2012 204 251.2 filed Mar. 19, 2012, the contents of which are hereby incorporated by reference in their entirety.

TECHNICAL FIELD

The present invention relates to a method for operating a fuel injection system of an internal combustion engine, wherein the fuel injection system has a pressure reservoir (rail), at least one injection valve with piezo direct-drive, in which a piezoelectric actuator is in direct drive connection with a closure element of the injection valve, a sensor for detecting the pressure (rail pressure) prevailing in the pressure reservoir (rail), and a control and regulating unit.

BACKGROUND

Fuel injection systems with which fuel injection into a combustion chamber of an internal combustion engine is performed have long been known. Injection systems of this kind comprise at least one injection valve (injector) and at least one control and regulating unit, connected to the injection valve, for controlling the injection process. Here, the injection valve has a space from which fuel can be injected into the combustion chamber through an injection opening. The opening and closing of the injection opening is performed by means of a closure element (nozzle needle), which can be actuated (moved) by an actuator. The space is supplied with fuel via a high-pressure reservoir and a fuel line.

The actuator is an element for moving the closure element. Thus, an injection process is controlled with the aid of the actuator. At the same time, the actuator is in direct drive connection with the closure element, which means that the actuator and the closure element are in direct mechanical contact or are connected to one another via interposed solid bodies, such as pins, levers or pistons. The essential point here is that there is no hydraulic or pneumatic coupling between the actuator and the closure element.

The actuator is a piezoelectric actuator which expands (increases in length) by virtue of the piezoelectric effect when supplied with electrical energy and in this way moves the closure element directly.

In fuel injection systems of this kind, it is necessary to detect the pressure prevailing in the pressure reservoir in order to be able to carry out appropriate control of the rail pressure. For this purpose, use is made in the prior art of special pressure sensors which are built into the pressure reservoir. This leads to an increase in overall system costs.

SUMMARY

One embodiment provides a method for operating a fuel injection system of an internal combustion engine, wherein the fuel injection system has a pressure reservoir, at least one injection valve with piezo direct-drive, in which a piezoelectric actuator is in direct drive connection with a closure element of the injection valve, a pressure sensor for detecting the pressure prevailing in the pressure reservoir, and a control and regulating unit, wherein use is made of a piezoelectric actuator which, in addition to an active piezoelectric region used for actuating the closure element, has a passive piezoelectric region, which forms the pressure sensor for detecting the pressure prevailing in the pressure reservoir, wherein the force acting on the passive piezoelectric region through the closure element and, from said force, the pressure prevailing in the pressure reservoir are determined.

In a further embodiment, the pressure prevailing in the pressure reservoir is determined in a phase in which the closure element is in the closed state without activation of the active piezoelectric region.

In a further embodiment, the force acting on the passive piezoelectric region is determined taking into account an offset force additionally acting on the passive piezoelectric region.

In a further embodiment, the force acting on the passive piezoelectric region is determined from the relation $$F_s = A_p * P_\text{rail} - A_s * P_low$$

wherein

- F_s=force exerted on the passive piezoelectric region (pressure sensor)
- A_p=surface of a connecting member between the piezoelectric actuator and the closure element or a further connecting member
- P_rail=pressure prevailing in the pressure reservoir
- A_s=area of the passive piezoelectric region (pressure sensor)
- P_low=low pressure
- and in that the pressure prevailing in the pressure reservoir is determined on the basis of the force acting.

In a further embodiment, the force acting on the passive piezoelectric region is determined with the aid of a characteristic curve from the electric voltage measured across the passive piezoelectric region.

In a further embodiment, the pressure prevailing in the pressure reservoir and determined with the aid of the pressure sensor is used in combination with a setpoint pressure value for pressure regulation in the fuel injection system.

In a further embodiment, the fuel injection system has a plurality of fuel injection valves, wherein the pressure prevailing in the pressure reservoir is determined at least once before injection by each injection valve.

In a further embodiment, the fuel injection system has a plurality of fuel injection valves, wherein the pressure prevailing in the pressure reservoir is formed from the average of the pressure values of all the injection valves, which are determined individually at the same time.

In a further embodiment, in a function test on the injection valve, a defined pressure P_s0 is set in the pressure reservoir, and the force F_s0 is determined by means of the pressure sensor, and from this the characteristic curve profile between F_s and P_rail is determined for each individual injection valve and stored.

Another embodiment provides a fuel injection system of an internal combustion engine having a pressure reservoir, at least one injection valve with piezo direct-drive, in which a piezoelectric actuator is in direct drive connection with a closure element of the injection valve, a pressure sensor for detecting the pressure prevailing in the pressure reservoir, and a control and regulating unit, wherein the system is set up for carrying out any of the methods disclosed above.

In a further embodiment, the piezoelectric actuator has a passive piezoelectric region, which is formed by at least one additional, serially arranged passive piezoelectric layer, which is electrically insulated from the active piezoelectric layers.

BRIEF DESCRIPTION OF THE DRAWINGS

Example embodiments of the invention are explained in detail below with reference to the drawings, in which.

DETAILED DESCRIPTION

Figure 1:
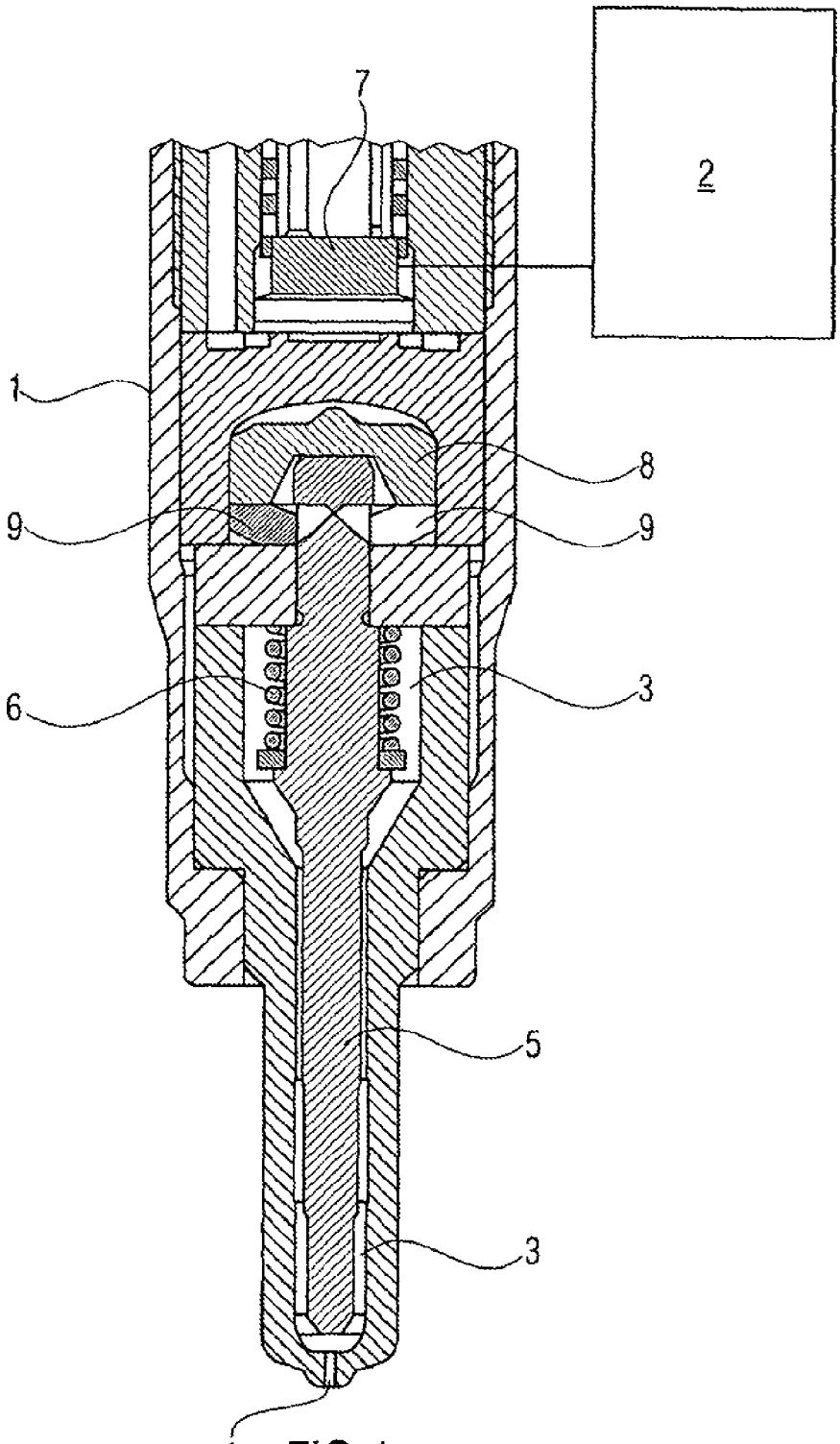
FIG. 1 shows a schematic partial longitudinal section through an injection valve.

Some embodiments of the present invention provide a method that uses a piezoelectric actuator which, in addition to the active piezoelectric region used for actuating the closure element, has a passive piezoelectric region, which forms the pressure sensor, wherein the force of the closure element acting on the passive piezoelectric region and, from said force, the pressure prevailing in the pressure reservoir (rail pressure) are determined.

In the disclosed method, no use is made of an additional pressure sensor mounted on the pressure reservoir, e.g. a "common rail"; instead, the pressure is detected with the aid of the piezoelectric actuator, which is used in the injection valve in any case. For this purpose, use is made of a piezoelectric actuator which is supplemented by a passive piezoelectric region, which is not used to actuate the closure element but serves as a pressure sensor. Here, use is made of the inverse piezoelectric effect, namely that the exertion of pressure on this passive piezoelectric region produces or changes an electric measurement variable, which is detected and from which the pressure prevailing in the pressure reservoir (rail pressure) is determined.

Thus, in the disclosed method, use is made of a unit consisting of the actual piezoelectric actuator, which brings about the actuation of the closure element, and of a pressure sensor. Since here the piezoelectric actuator has only to be supplemented by a passive piezoelectric region, the additional outlay required for pressure detection is relatively low, and therefore the method according to the invention can be carried out at lower cost than with the arrangement of a special separate pressure sensor in the pressure reservoir.

In the disclosed method, the pressure prevailing in the pressure reservoir (rail pressure) is preferably determined in the phase in which the closure element is in the closed state without activation of the active piezoelectric region. In the method according to the invention, therefore, there are two separate phases: on the one hand, an injection phase, during which the active piezoelectric region is activated in order to open the closure element and, on the other hand, a pressure detection phase, during which detection of the pressure in the pressure reservoir is carried out by application of pressure to the passive piezoelectric region.

With the aid of the passive piezoelectric region (pressure sensor), the force exerted on the passive piezoelectric region by the closure element and, from said force, the rail pressure are determined. This is preferably accomplished while taking into account the offset force additionally acting on the passive piezoelectric region in order to allow precise pressure detection. Here, the force acting on the passive piezoelectric region is determined specifically from the relation $$F_s = A_p * P_rail - A_s * P_low$$

wherein

F_s=force exerted on the passive piezoelectric region (pressure sensor),

A_p=surface of a connecting member (pin) between the piezoelectric actuator and the closure element or a further connecting member (lever), P_rail=pressure prevailing in the pressure reservoir, A_s=area of the passive piezoelectric region (pressure sensor), P_low=low pressure.

With the aid of the force calculated from the above relation, the pressure prevailing in the pressure reservoir (rail pressure) P_rail is determined.

In the disclosed method, use is preferably made of an injection valve with direct-drive, in which a pin connects the piezoelectric actuator on the low-pressure side and a lever on the high-pressure side to one another, said lever being in drive connection with the closure element. Since the low pressure P_low is held constant, this is known. The offset force on the pressure sensor is determined by means of the area of the passive piezoelectric region (pressure sensor) A_s and the low pressure P_low. The high pressure, i.e. the pressure prevailing in the space of the closure element, is connected directly to the rail pressure and thus corresponds to the rail pressure P_rail. The force F_s additionally exerted on the pressure sensor is thus determined by the area of the pin A_p and the high pressure.

The force acting on the passive piezoelectric region is preferably determined from the measured electric voltage of the passive piezoelectric region and, from said voltage, by means of a characteristic curve. A characteristic curve of this kind can be stored in the associated control and regulating unit, for example. The rail pressure P_rail can thus be determined as the ACTUAL rail pressure.

The pressure prevailing in the pressure reservoir (rail pressure) and determined with the aid of the piezoelectric actuator/pressure sensor (ACTUAL pressure) can, of course, be used in combination with a setpoint pressure value for pressure regulation in the fuel injection system. In this case, the ACTUAL pressure is detected in a manner according to the invention, compared with a setpoint pressure value, and appropriate adaptation is performed to regulate the pressure.

The disclosed method finds application specifically in a fuel injection system which has a plurality of fuel injection valves. Here, the pressure prevailing in the pressure reservoir (rail pressure) is preferably determined at least once before injection in each injection valve. In this way, the subsequent injection process can be subjected to control or regulation taking into account the actual pressure conditions, and there is no need for the use of a separate pressure sensor.

In a fuel injection system of this kind having a plurality of fuel injection valves, the pressure prevailing in the pressure reservoir (rail pressure) is preferably formed from the average of the individually determined pressure values of all the injection valves.

The pressure difference of the individual injection valve can then be used for diagnosis.

In order to increase pressure measurement accuracy, a defined pressure P_s0 can be set in the pressure reservoir in a function test on the injection valve during series production. During this process, the electric voltage V_0 of the pressure sensor is read off, and from this the force F_s0 is determined. From this, the characteristic curve profile, in particular the characteristic curve slope between F_s and P_rail, can then be determined for each individual injector and stored. After this, said value can be read into the control and regulating unit.

Other embodiments of the present invention provide a fuel injection system of an internal combustion engine having a pressure reservoir (rail), at least one injection valve with piezo direct-drive, in which a piezoelectric actuator is in direct drive connection with a closure element of the injection valve, a sensor for detecting the pressure (rail pressure) prevailing in the pressure reservoir (rail), and a control and regulating unit. This fuel injection system is wherein is set up for carrying out a method of the kind described above. By virtue of the fact that a fuel injection system of this kind does not require any special pressure sensor, built into the pressure reservoir, for rail pressure detection and rail pressure control, a system of this kind is associated with lower overall costs in comparison with the prior art and has a simplified construction.

In the disclosed fuel injection system, the piezoelectric actuator therefore has an integrated pressure/force sensor. The sensor is formed by an additional passive piezoelectric region. This is at least one additional, serially arranged passive piezoelectric layer, which is electrically insulated from the active piezoelectric layers, is arranged on a piezoelectric stack of layered design forming the active piezoelectric region and is separated from the latter by suitable insulation. The passive piezoelectric region preferably has electrodes on both sides for tapping off the electric voltage produced.

FIG. 1 shows an injection valve 1, which is connected to a schematically represented control and regulating unit 2. The injection valve 1 is used in a diesel engine of a passenger vehicle, for example. It is used to inject fuel into a combustion chamber of an internal combustion engine. It has a space 3, which is connected to a pressure reservoir (high-pressure reservoir) by a fuel line (not shown here). The injection valve 1 illustrated here is one of a multiplicity of injection valves which are each connected in a common rail system to the same pressure reservoir by fuel lines. At the bottom end of the injection valve 1, said valve has an injection opening 4, through which fuel can be injected from the space 3 into the combustion chamber.

Arranged in the space is a nozzle needle 5 serving as a closure element, by means of which the injection opening 4 can be opened and closed. When the nozzle needle 5 is in an open position, in which it exposes the injection opening 4, fuel under high pressure is injected from the space 3 into the combustion chamber. In a closed position of the nozzle needle 5, in which the nozzle needle 5 closes the injection opening 4, injection of fuel into the combustion chamber is prevented.

The nozzle needle 5 is controlled by means of a closing spring 6 arranged in the upper section of the space 3 by means of a piezoelectric actuator 7 that directly actuates the nozzle needle 5 and is connected electrically to the control and regulating unit. Depending on activation by the control and regulating unit 2, the piezoelectric actuator 7 can change in length and exert a force on the nozzle needle 5, wherein the force can be transmitted to the nozzle needle 5 via a pin (concealed in the figure), via a bell 8 and via levers 9. Via the pin, the bell 8 and the levers 9, the piezoelectric actuator 7 and the nozzle needle 5 are mechanically coupled in a direct manner. A force exerted by the piezoelectric actuator 7 is therefore transmitted directly to the nozzle needle 5. Conversely, a mechanical force exerted by the nozzle needle 5 acts directly on the piezoelectric actuator 7. When the piezoelectric actuator 7 is not being supplied with electric energy, the closing spring 6 pushes the nozzle needle 5 downward in FIG. 1, with the result that it closes the injection opening 4 against the pressure in the space 3 and prevents injection. When the piezoelectric actuator 7 is supplied with electric energy, the piezoelectric actuator 7 increases in length and exerts a force on the nozzle needle 5, as a result of which the injection opening 4 is opened by means of the nozzle needle 5.

In addition to the active piezoelectric region used to actuate the nozzle needle 5, the piezoelectric actuator 7, which is illustrated only schematically in FIG. 1, has a passive piezoelectric region as a pressure sensor. With the aid of this pressure sensor, the force exerted on the passive piezoelectric region by the nozzle needle 5 and hence the pressure prevailing in the pressure reservoir (rail pressure) is determined.

Figure 2:
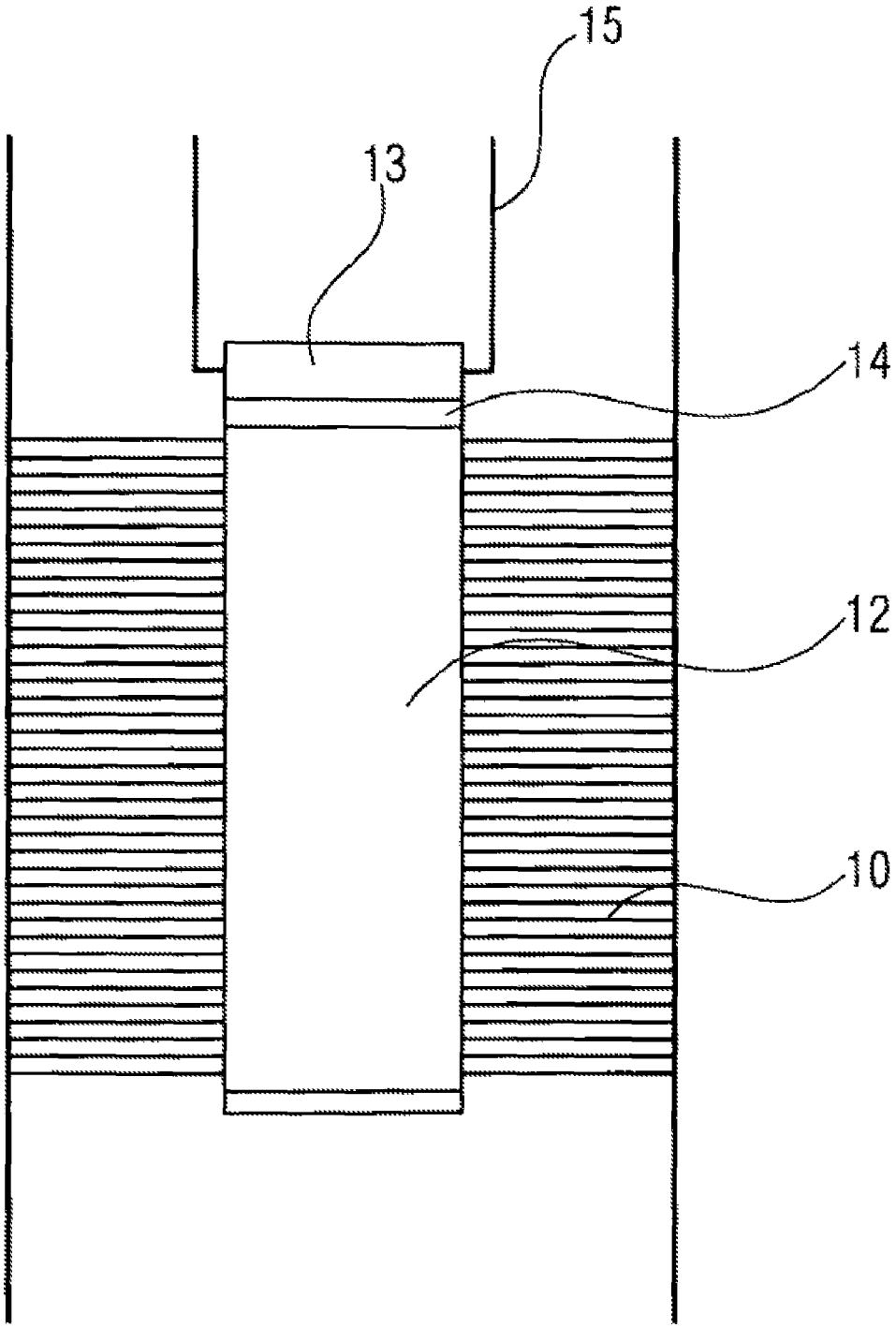
FIG. 2 shows a schematic partial longitudinal section through a piezoelectric actuator having a force sensor.
Figure 3:
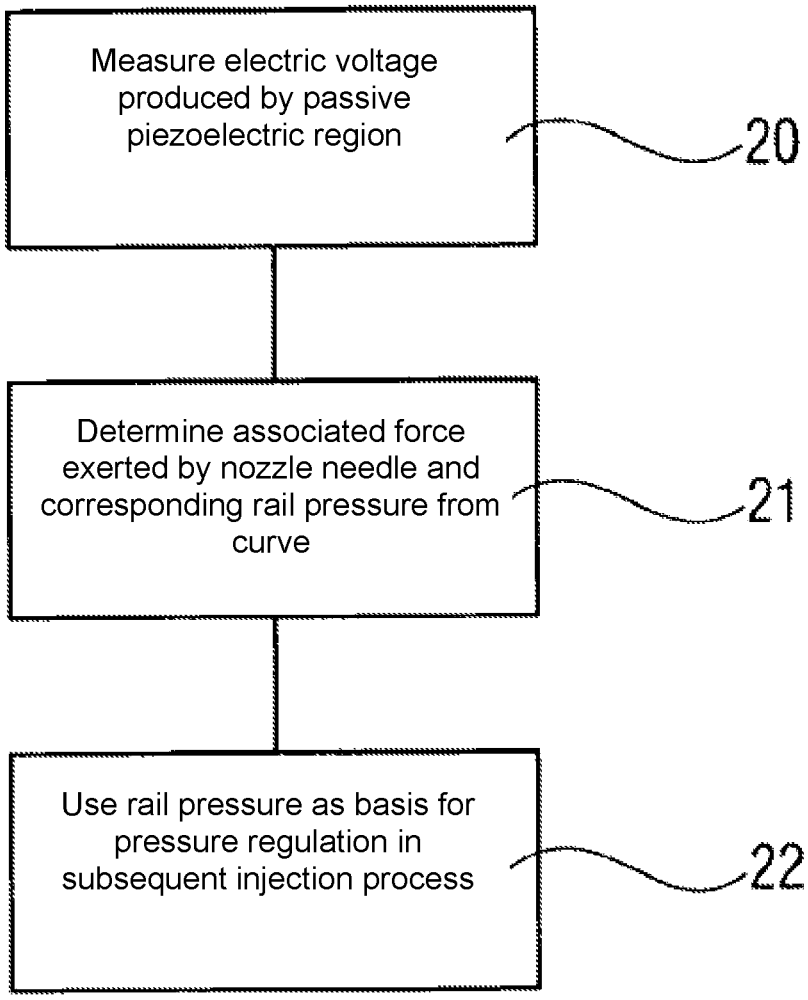
FIG. 3 shows a flow diagram of the method.

FIG. 2 shows schematically the construction of the piezoelectric actuator 7, which forms a constructional unit that has the active piezoelectric region 12 for actuating the nozzle needle 5 and the passive piezoelectric region 13 for pressure detection. The active piezoelectric region 12 consists of a multiplicity of active piezoelectric layers arranged one above the other, which have respective corresponding connection electrodes 10 on the left and on the right. Arranged on the topmost active piezoelectric layer, isolated by suitable insulation 14, is a passive piezoelectric layer, which forms the piezoelectric region 13 acting as a force sensor or pressure sensor. The passive piezoelectric layer is provided on both sides with corresponding connection electrodes 15.

The operation of the fuel injection system described here takes place as follows. There is a pressure detection phase and an injection phase. Before injection, the rail pressure is determined by determining the force exerted by the nozzle needle 5 on the passive piezoelectric region 13 by measurement of the electric voltage produced by the passive piezoelectric region. The associated force and, from the latter, the rail pressure are determined from the measured voltage in the manner described above by means of corresponding characteristic curves stored in the control and regulating unit. This pressure detection phase is carried out with the nozzle needle closed.

The rail pressure determined (ACTUAL pressure) is then used for rail pressure regulation for the subsequent injection, during which the active piezoelectric region of the actuator is activated in order to raise the nozzle needle from the seat and expose the injection opening.

In a pressure detection phase, i.e. with the nozzle needle closed and before an injection process, the force exerted on the passive piezoelectric region by the nozzle needle is determined in step 20 by measuring the electric voltage produced by the passive piezoelectric region. In step 21, the associated force and, from the latter, the rail pressure are determined from the measured voltage by means of a characteristic curve. In step 22, the rail pressure determined is then used for pressure regulation in a subsequent injection process.

What is claimed is:

1. A method for operating a fuel injection system of an internal combustion engine, wherein the fuel injection system has a pressure reservoir, at least one injection valve with piezo direct-drive in which a piezoelectric actuator is in a direct drive connection with a closure element of the injection valve, a pressure sensor that detects a pressure in the pressure reservoir, and a control and regulating unit, wherein the piezoelectric actuator includes an active piezoelectric region used for actuating the closure element and a passive piezoelectric region that forms the pressure sensor for detecting the pressure in the pressure reservoir, the method comprising:

determining a force acting on the passive piezoelectric region through the closure element, and determining the pressure in the pressure reservoir based on the determined force acting on the passive piezoelectric region; and regulating pressure in the fuel injection system based on (a) the pressure in the pressure reservoir determined using the pressure sensor and (b) a setpoint pressure value.

2. The method of claim 1, wherein the pressure in the pressure reservoir is determined in a phase in which the closure element is in the closed state without activation of the active piezoelectric region.

3. The method of claim 1, wherein the determination of the force acting on the passive piezoelectric region accounts for an offset force additionally acting on the passive piezoelectric region.

4. The method of claim 3, wherein the force acting on the passive piezoelectric region is determined based on the equation:

$$F_s=A_p*P_\text{rail}-A_s*P_low$$

wherein

F_s=a force exerted on the passive piezoelectric region,

A_p=a surface of a connecting member between the piezoelectric actuator and the closure element or a further connecting member, P_rail=the pressure in the pressure reservoir, A_s=an area of the passive piezoelectric region, and and P_low=low pressure.

5. The method of claim 1, wherein the force acting on the passive piezoelectric region is determined using a characteristic curve from an electric voltage measured across the passive piezoelectric region.

6. The method of claim 1, wherein the fuel injection system has a plurality of fuel injection valves, and wherein the pressure in the pressure reservoir is determined at least once before an injection by each injection valve.

7. The method of claim 1, wherein the fuel injection system has a plurality of fuel injection valves, and wherein the method comprises:

determining respective pressure values for all of the injection valves at the same time, and calculating the pressure in the pressure reservoir based on an average of determined pressure values of all of the injection valves.

8. The method of claim 1, comprising:

during a function test on each respective injection valve:

setting a defined pressure in the pressure reservoir, determining a force using the pressure sensor, and determining and storing a characteristic curve profile for the respective injection valve.

9. A fuel injection system of an internal combustion engine, comprising:

a pressure reservoir, at least one injection valve with piezo direct-drive, in which a piezoelectric actuator is in direct drive connection with a closure element of the injection valve, wherein the piezoelectric actuator includes an active piezoelectric region used for actuating the closure element and a passive piezoelectric region that forms a pressure sensor for detecting the pressure in the pressure reservoir, wherein the passive piezoelectric region of the piezoelectric actuator is configured to determine a force, and a control and regulating unit programmed to determine the pressure in the pressure reservoir based on the determined force acting on the passive piezoelectric region; and regulate pressure in the fuel injection system based on (a) the pressure in the pressure reservoir determined using the pressure sensor and (b) a setpoint pressure value.

10. The fuel injection system of claim 9, wherein the piezoelectric actuator has a passive piezoelectric region, which is formed by at least one additional, serially arranged passive piezoelectric layer, which is electrically insulated from the active piezoelectric layers.

11. The fuel injection system of claim 9, wherein the pressure in the pressure reservoir is determined in a phase in which the closure element is in the closed state without activation of the active piezoelectric region.

12. The fuel injection system of claim 9, wherein the determination of the force acting on the passive piezoelectric region accounts for an offset force additionally acting on the passive piezoelectric region.

13. The fuel injection system of claim 12, wherein the force acting on the passive piezoelectric region is determined based on the equation:

$$F_s=A_p*P_\text{rail}-A_s*P_low$$

wherein

F_s=a force exerted on the passive piezoelectric region,

A_p=a surface of a connecting member between the piezoelectric actuator and the closure element or a further connecting member, P_rail=the pressure in the pressure reservoir, A_s=an area of the passive piezoelectric region, and and P_low=low pressure.

14. The fuel injection system of claim 9, wherein the force acting on the passive piezoelectric region is determined using a characteristic curve from an electric voltage measured across the passive piezoelectric region.

15. The fuel injection system of claim 9, wherein the fuel injection system has a plurality of fuel injection valves, and wherein the pressure in the pressure reservoir is determined at least once before an injection by each injection valve.

16. The fuel injection system of claim 9, comprising a plurality of fuel injection valves, and wherein the control and regulating unit is programmed to:

determine respective pressure values for all of the injection valves at the same time, and calculate the pressure in the pressure reservoir based on an average of determined pressure values of all of the injection valves.

17. The fuel injection system of claim 9, control and regulating unit is programmed to, during a function test on each respective injection valve:

set a defined pressure in the pressure reservoir, determine a force using the pressure sensor, and determine and storing a characteristic curve profile for the respective injection valve.

* * * * *